US009103245B2

(12) United States Patent
Pegg et al.

(10) Patent No.: US 9,103,245 B2
(45) Date of Patent: Aug. 11, 2015

(54) ENGINE SYSTEM AND A METHOD OF MANUFACTURING SAME

(71) Applicant: Ford Global Technologies, LLC, Dearborn, MI (US)

(72) Inventors: Ian Graham Pegg, Chelmsford (GB); Roland Paul Stark, Hitchin (GB); Robert Helle-Lorentzen, Chelmsford (GB); Paul Shayler, Nottingham (GB)

(73) Assignee: Ford Global Technologies, LLC, Dearborn, MI (US)

( * ) Notice: Subject to any disclaimer, the term of this patent is extended or adjusted under 35 U.S.C. 154(b) by 121 days.

(21) Appl. No.: 13/874,324

(22) Filed: Apr. 30, 2013

(65) Prior Publication Data

US 2013/0306021 A1 Nov. 21, 2013

(30) Foreign Application Priority Data

May 21, 2012 (GB) ..... 1208935.5
Apr. 10, 2013 (GB) ..... 1306501.6
Apr. 10, 2013 (GB) ..... 1306502.4

(51) Int. Cl.
*F01M 7/00* (2006.01)
*F01M 5/02* (2006.01)
*F01M 11/02* (2006.01)

(52) U.S. Cl.
CPC . *F01M 7/00* (2013.01); *F01M 5/02* (2013.01); *F01M 11/02* (2013.01)

(58) Field of Classification Search
CPC ..... F01M 7/00; F01M 1/06; F01M 5/00; F01M 5/001; F01M 5/021; F01M 11/00; F01M 11/02
USPC ..... 123/195 R, 196 R, 196 AB; 184/104.1, 184/104.2, 104.3
See application file for complete search history.

(56) References Cited

U.S. PATENT DOCUMENTS 5,862,866 A * 1/1999 Springer ..... 166/380
6,382,259 B1 * 5/2002 Codling ..... 138/149
7,037,557 B2 * 5/2006 Keyes ..... 427/243
7,677,228 B2 * 3/2010 Manookian, Jr. ..... 123/572

(Continued)

FOREIGN PATENT DOCUMENTS

DE 19854521 C1 * 6/2000
DE 102012207431 A1 * 11/2013

(Continued)

OTHER PUBLICATIONS

Delegue et al., Detailed Description of FR2910554A1, machine translation obtained from http://worldwide.espacenet.com/, pp. 1-8.*

(Continued)

*Primary Examiner* — Lindsay Low
*Assistant Examiner* — Grant Moubry
(74) *Attorney, Agent, or Firm* — Julia Voutyras; Alleman Hall McCoy Russell & Tuttle LLP

(57) ABSTRACT

An engine system is disclosed in which the transfer of heat from pressurized oil flowing through an integrally formed oil transfer passage of the engine is reduced by providing a thermal barrier between the oil and the engine. In one example the thermal barrier is provided by the use of a thick walled plastic tube and in other embodiments ribs are used to separate an oil flow passage from the engine.

23 Claims, 8 Drawing Sheets

(56) References Cited

U.S. PATENT DOCUMENTS

| | | | | |
|---|---|---|---|---|
| 7,913,677 | B2 * | 3/2011 | Manookian, Jr. | 123/572 |
| 8,616,246 | B2 * | 12/2013 | Dinon et al. | 138/149 |
| 2004/0197212 | A1 | 10/2004 | Roby | |
| 2011/0079187 | A1 | 4/2011 | Steiner et al. | |
| 2011/0253092 | A1 | 10/2011 | Springer et al. | |

FOREIGN PATENT DOCUMENTS

| | | | |
|---|---|---|---|
| FR | 2910554 | A1 * | 6/2008 |
| GB | 1236190 | A * | 6/1971 |
| GB | 2251889 | A | 7/1992 |
| GB | 2472228 | A | 2/2011 |
| JP | H07279636 | A | 10/1995 |
| JP | H094430 | A | 1/1997 |
| JP | H0913934 | A | 1/1997 |
| JP | 2004232546 | A | 8/2004 |

OTHER PUBLICATIONS

Jones, Graham J., "The Influence of Geometry and Grooving on the Measured Temperatures of Engine Crankshaft Bearings," SAE Technical Paper Series No. 960989, International Congress and Exposition, Detroit, MI., Feb. 26-29, 1996, 8 pages.

* cited by examiner

ENGINE SYSTEM AND A METHOD OF MANUFACTURING SAME

CROSS REFERENCE TO RELATED APPLICATIONS

The present application claims priority to United Kingdom Patent Application No. 1306501.6, filed on Apr. 10, 2013 and United Kingdom Patent Application No. 1306502.4, filed on Apr. 10, 2013, which claims priority to United Kingdom Patent Application No. 1208935.5, filed on May 21, 2012, the entire contents of each of which are hereby incorporated by reference for all purposes.

FIELD

This invention relates to internal combustion engines and in particular to the reduction of fuel usage by an engine following a start-up from cold.

BACKGROUND AND SUMMARY

It is well known in the art that following a start-up from cold, that is to say, an engine start-up where the temperature of the engine is close to ambient temperature, significant losses are produced due to the lubricating oil being below an optimum operating temperature. These losses increase fuel usage during the initial warm-up period and in addition wear is increased if the oil is below a minimum temperature at which additives in the oil become fully activated.

Several methods have therefore been previously proposed to either actively heat the oil by the use of electric oil heaters or by heat transfer with the exhaust gas from the engine or by passive heating by recirculating at least some of the oil that has already passed through the engine thereby speeding up the heating of the oil by the use of partitioned oil reservoirs such as that shown in published patent application GB-A-2251889.

It is a problem with all such previous attempts that, although the temperature of the oil may be increased by these measures before it enters the engine, the very large thermal mass of the engine compared to the thermal mass of the oil means results in the temperature of the oil rapidly reducing as it flows through the engine by the transfer of heat from the oil to the engine. Therefore, by the time the oil reaches the key components of the engine requiring lubrication such as the main bearing of the crankshaft its temperature will normally be close to the temperature of the engine components through which it has passed. In addition, the high thermal mass of the engine means that it will take several minutes for the engine to attain its normal operating temperature of approximately 90° C. after a cold start and during this period of time the oil will likely be more viscous and may have lower lubricating properties than are desirable for optimum fuel efficiency. Although this is a particular problem following a start-up from cold it can be a persistent problem with some engines if the oil passages to the bearings are located in a cool part of the engine where the temperature of the engine during normal running of the engine remains below that required for optimum oil operation.

DETAILED DESCRIPTION

Figure 1:
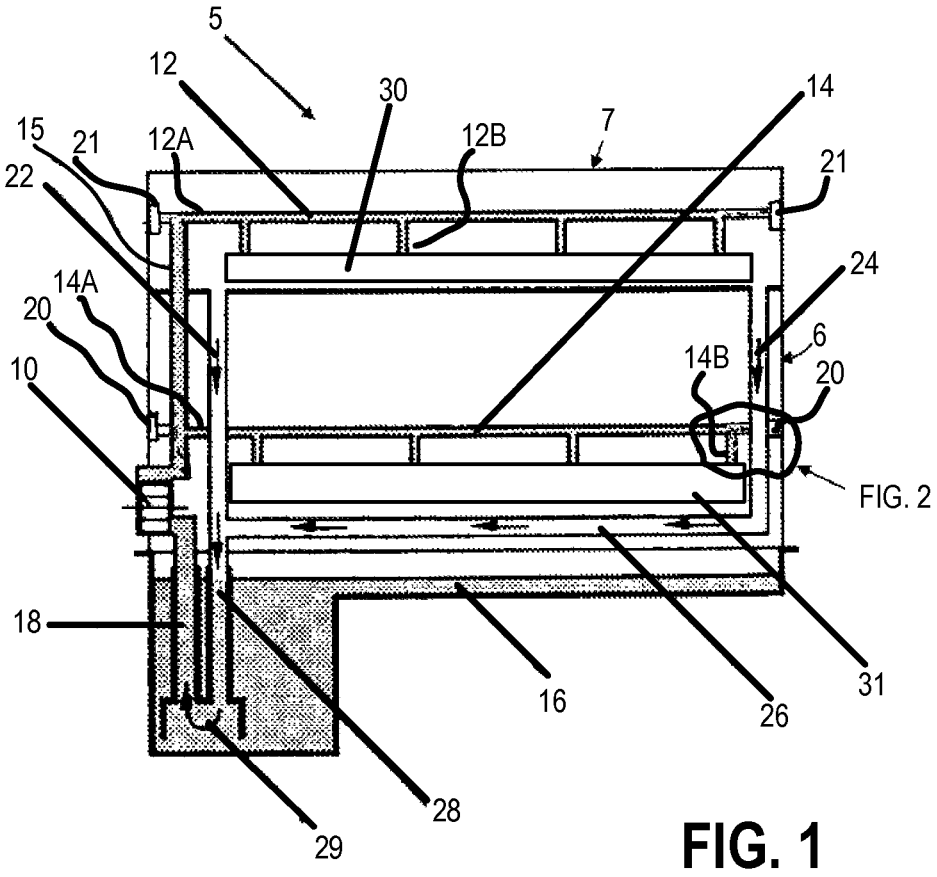
FIG. 1 shows a schematic diagram of an engine system including a thermal barrier located in an oil transfer passage.

According to a first aspect of the invention there is provided an engine system comprising an engine having an oil transfer passage formed therein through which oil flows in use, the oil transfer passage including a thermal barrier having a low thermal conductivity interposed between the oil and the engine to reduce the transfer of heat from the oil to the engine wherein the thermal barrier comprises a plastic tube having a low thermal conductivity fitted into the oil transfer passage, the plastic tube defining an oil flow passage through which the oil flows in use.

The plastic tube may be a thick walled plastic tube.

The plastic tube may have a number of external ribs formed to space it from a wall defining the oil transfer passage.

The external ribs may extend longitudinally along the tube.

The ribs may extend helically along the tube.

The ribs may extend helically in opposite rotational directions.

Alternatively, the external ribs may extend circumferentially around the tube.

As a first alternative, the plastic tube may be an inner plastic tube and an outer plastic tube may be spaced apart from the inner plastic tube by the external ribs, the inner plastic tube defining an oil flow passage through which the oil flows in use and the outer plastic tube having an outer surface engaging with a wall defining the respective oil transfer passage.

The inner and outer plastic tubes may be formed as a single component.

The external ribs may define a number of compartments forming part of the thermal barrier.

The engine may have a cylinder block and the oil transfer passage may be a main gallery formed in the cylinder block of the engine. In which case, the main gallery may supply oil to at least one main bearing of the engine.

Alternatively, the engine may have a cylinder head and the oil transfer passage may be an oil supply gallery formed in the cylinder head of the engine. In which case, the oil supply gallery may supply oil to at least one camshaft bearing of the engine.

As yet another alternative, the engine may have a cylinder block and a cylinder head and there may be two oil transfer passages and the two oil transfer passages may comprise a main gallery formed in the cylinder block of the engine and an oil supply gallery formed in the cylinder head of the engine.

The engine system may further comprise an oil pump to cause oil to flow through the at least one oil transfer passage.

According to a second aspect of the invention there is provided a method of reducing fuel usage of an engine having an oil transfer passage formed therein wherein the method comprises push fitting a plastic tube defining an oil flow passage through which the oil flows in use into the oil transfer passage to reduce the transfer of heat from the oil to the engine.

The plastic tube may have a number of ribs formed on an outer surface to space the plastic tube from a wall of the oil transfer passage.

The plastic tube may be an inner plastic tube defining an oil flow passage through which the oil flows in use and a number of ribs formed on an outer surface of the inner plastic tube may be used to space the inner plastic tube from an outer plastic tube that has an outer surface engaging a wall of the oil transfer passage.

According to a third aspect of the invention there is provided an engine having at least one oil transfer passage formed therein through which oil flows in use, the at least one oil transfer passage includes a thermal barrier interposed between the oil and the engine wherein the thermal barrier comprises a closed cell foam tube made from a material having a low thermal conductivity.

The closed cell foam tube may have an outer surface in contact with the oil transfer passage and a bore defining an oil flow passage through which oil flows in use.

The closed cell foam tube may be a pre-formed closed cell tube that is inserted into the oil flow passage.

Alternatively, the closed cell foam tube may be made in-situ by injecting a foamable material into the oil transfer passage.

The closed cell foam tube may be fitted over an inner tube defining an oil flow passage through which oil flows in use.

The inner tube may be made from a heat and oil resistant plastic material.

The inner tube may be a thin plastic tube.

The closed cell foam tube may be fitted over an inner tube defining an oil flow passage through which oil flows in use and an outer tube may be fitted over the closed cell foam tube such that the closed cell foam tube is interposed between the inner and outer tubes.

The outer tube may be made from a heat and oil resistant plastic material.

The outer tube may be a thin plastic tube.

The inner tube, the outer tube and the closed cell foam tube may be pre-formed and then assembled together to form a composite tube assembly.

The inner tube and the outer tube may be pre-formed and the closed cell foam tube may be made in-situ by injecting a foamable material between the inner and outer tubes while holding the inner and outer tubes in a predefined relationship.

The engine may have a cylinder block and the at least one oil transfer passage may be a main gallery formed in the cylinder block of the engine.

The engine may have a cylinder head and the at least one oil transfer passage may be an oil supply gallery formed in the cylinder head of the engine.

According to a fourth aspect of the invention there is provided a method of manufacturing an engine constructed in accordance with said first aspect of the invention wherein the method comprises producing an oil transfer passage in part of the engine and providing the oil transfer passage with a thermal barrier to reduce the transfer of heat from oil passing through the oil transfer passage to the surrounding engine, the thermal barrier comprising a closed cell foam tube.

The closed cell foam tube may be pre-formed and may be inserted into the oil transfer passage to provide the thermal barrier.

The closed cell foam tube may have a bore and the closed cell foam tube may be inserted into the oil transfer passage by being pulled into the respective oil transfer passage using a device inserted into the bore of the closed cell foam tube.

Providing the oil transfer passage with a thermal barrier to reduce the transfer of heat from oil passing through the oil transfer passage to the surrounding engine may comprise forming the closed cell foam tube in situ by injecting a foam material into the oil transfer passage and subsequently forming a bore in the injected foam.

Alternatively, providing the oil transfer passage with a thermal barrier to reduce the transfer of heat from oil passing through the oil transfer passage to the surrounding engine may comprise producing a composite tube assembly having an inner tube and an outer closed cell foam tube and inserting the composite tube assembly into the oil transfer passage.

Inserting the composite tube assembly into the oil transfer passage may comprise one of pulling and pushing the composite tube assembly into the oil transfer passage.

As yet a further alternative, providing the oil transfer passage with a thermal barrier to reduce the transfer of heat from oil passing through the oil transfer passage to the surrounding engine may comprise producing a first tube, a second tubes and a closed cell foam tube assembling the first, second tubes and closed cell foam tube together to form a composite tube assembly in which the closed cell foam tube is interposed between the first and second tubes and inserting the composite tube assembly into the oil transfer passage.

Alternatively, providing the oil transfer passage with a thermal barrier to reduce the transfer of heat from oil passing through the oil transfer passage to the surrounding engine may comprise producing a first tube and a second tubes and forming a closed cell foam tube in-situ by injecting foam between the first and second tubes to form a composite tube assembly in which the closed cell foam tube is interposed between the first and second tubes and inserting the composite tube assembly into the oil transfer passage.

Inserting the composite tube assembly comprised of first, second and closed cell foam tubes into the oil transfer passage may comprise one of pulling and pushing the composite tube assembly into the oil transfer passage.

Figure 2:
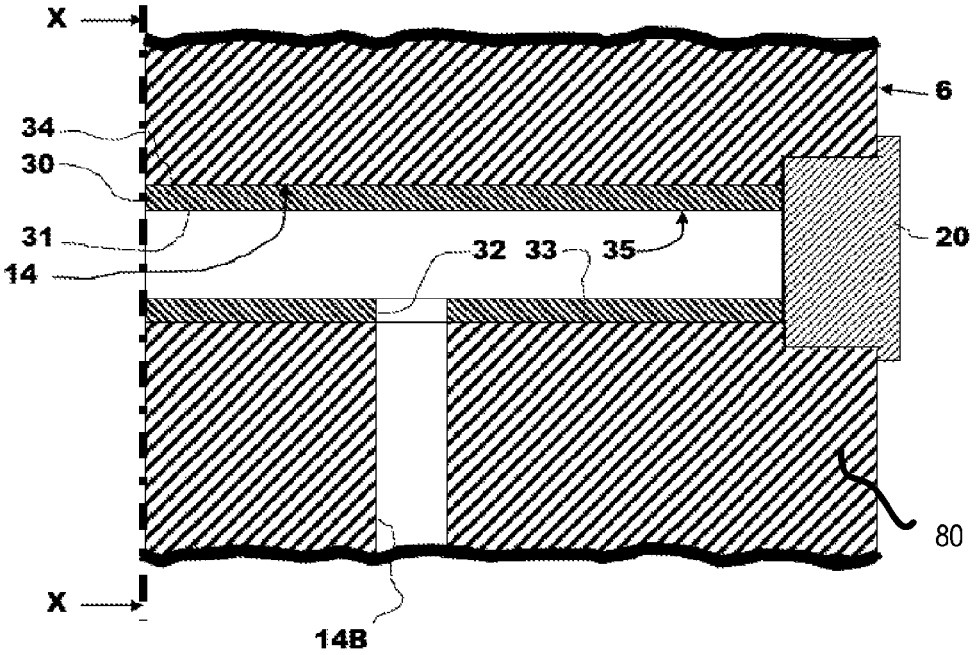
FIG. 2 shows a schematic diagram of an oil transfer passage including a thermal barrier.
Figure 3:
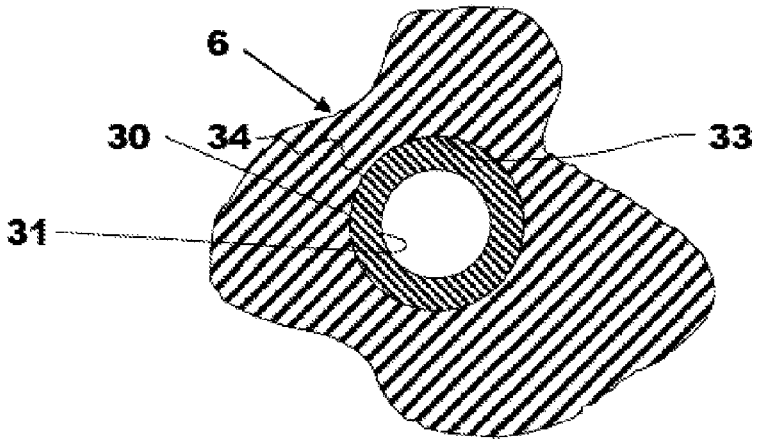
FIG. 3 shows a cross-section of an oil transfer passage including a thermal barrier.
Figure 13:
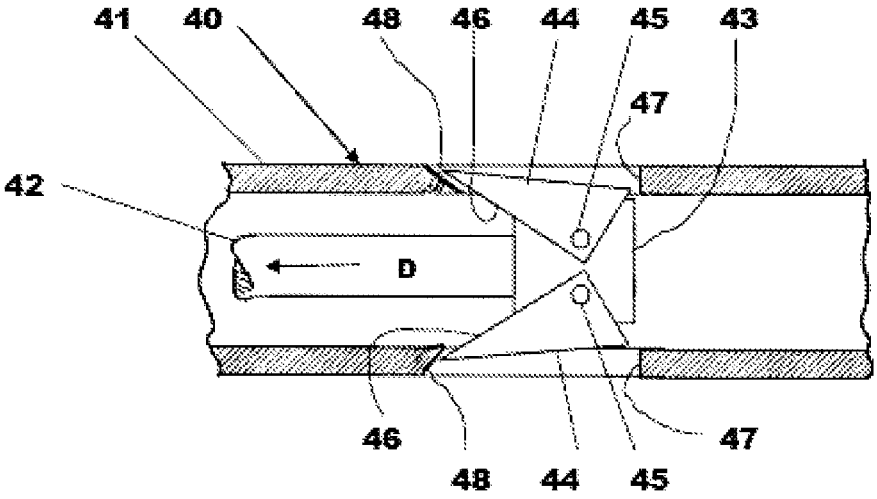
FIG. 13 shows a schematic diagram of an insertion device including barbs for a closed cell foam tube.
Figure 14:
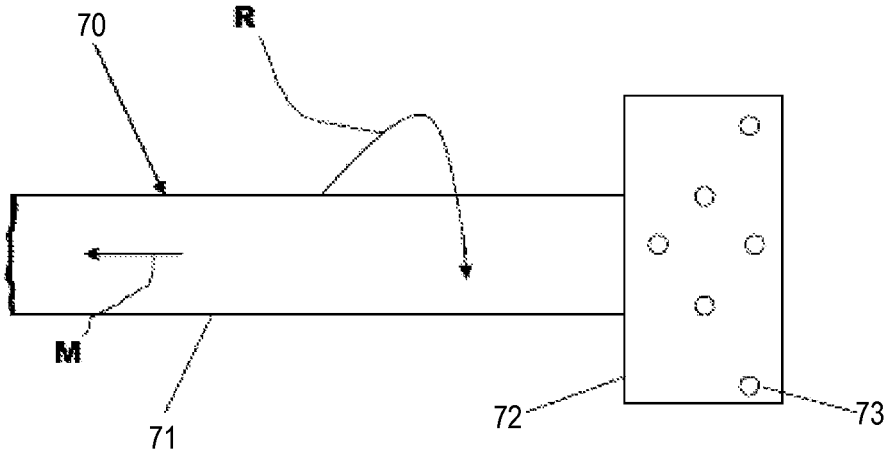
FIG. 14 shows a schematic diagram of a foam injection device for use in injecting a closed cell foam material into an oil transfer passage.

The following description relates to systems and methods for reducing heat transfer from oil flowing through the engine by a thermal barrier positioned in an oil transfer passage (FIG. 1). The thermal barrier is a plastic tubular component that acts as a thermal insulator to reduce the rate of heat transfer from the oil to the cylinder block (FIG. 2-3). The tubular component may have several embodiments including an inner and outer tube (FIG. 4) or containing longitudinally extended ribs or fins (FIG. 5). Further, the tubular components may contain apertures to provide oil flow passage to the main bearings (FIG. 6-8). In one example, the tubular components may be a composite tube. The composite tube may have several embodiments including a closed cell foam tube with an inner and outer plastic tube (FIG. 9) or containing a closed cell foam tube with an inner plastic tube (FIG. 10). Further, the composite tube may be push fit into place using an insertion device (FIGS. 11A-C) such that the insertion device has barbs to accurately put the composite tube in place (FIGS. 12-13). The manufacturing of the composite tube with the closed cell foam may involve injecting the closed cell foam into the oil transfer passage; therefore, the use of a foam injection device may be used to place the closed cell foam tube into the oil transfer passage (FIG. 14).

Referring to FIG. 1 there is shown an engine system 5 comprising an engine having a cylinder block 6 and a cylinder head 7 and an oil circulation pump 10 to pump oil through various integrally formed oil transfer passages 12, 12B; 14, 14B for use in lubricating various bearings (not shown) of the engine. It will be appreciated that the oil supplied from the pump 10 could also be supplied to one or more piston cooling jets or to one or more cam phase change actuators.

The oil circulation pump 10 has a suction pipe 18 opening in a main sump 16 of the engine and has a delivery passage 15 that discharges into first and second main oil galleries designated 12 and 14 respectively. The first oil gallery is an oil transfer passage 12 formed in the cylinder head 7 of the engine. The oil transfer passage 12 has an inlet end 12A connected to the delivery passage 15 and is connected to a number of camshaft bearing supply passages 12B formed in the cylinder head 7. The camshaft bearing supply passages 12B feed different journals in camshaft 30. End plugs 21 are used to block off the distal ends of the oil transfer passage 12.

The oil transfer passage 12 delivers oil to parts associated with the cylinder head 7 that require lubrication and cooling, notably all the surfaces associated with the valve train such as camshaft bearings, cams, followers, hydraulic tappets etc. The oil from the cylinder head 7 falls under gravity through two drainage passages 22 and 24 and would in a conventional engine fall back into the main body of the sump. However, in this case, in order to speed up oil warm-up following a cold start, a return passage 26 and a return pipe 28 are connected to the drainage passages 22, 24 so that the returned oil from the cylinder head 7 does not fall into the main sump 16 but flows into a small catchment volume 29 submerged in the main sump 16 and surrounding the suction pipe 18 of the circulation pump 10. The oil from the second gallery 14, used for lubricating and cooling the bottom end of the engine, may, as shown, drain back into the main body of the sump 16.

Alternatively, at least a portion of the oil from the second gallery 14 may be captured and fed to the small catchment volume 29 via one of the drainage passages 22, 24 or via an additional pipe (not shown).

It will be appreciated that the invention is not limited to the oil circulation system shown in FIG. 1. GB patent application 2,437,089 for example discloses an alternative sump arrangement aimed at increasing oil temperature during a warm-up period.

The second oil gallery is an oil transfer passage 14 formed in the cylinder block 6 of the engine. Flowing oil is pumped from a sump to cylinder block 6 to be delivered to a journal in the crankshaft via oil transfer passage 14. The oil transfer passage 14 has an inlet end 14A connected to the delivery passage 15 and is connected to a number of crankshaft bearing supply passages 14B formed in the cylinder block 6. The crankshaft bearing supply passages 14B feed different journals in crankshaft 31. End plugs 20 are used to block off the distal ends of the oil transfer passage 14.

In operation, oil is drawn from the sump catchment volume 29 and is delivered by the circulation pump 10 to the two oil transfer passages 12 and 14. After use at least some of the oil is immediately returned to the catchment volume 29 through the drainage passages 22, 24, the return passage 26 and 28 and once again is drawn into the suction pipe 18 of the circulation pump 10. The same oil therefore keeps circulating through the engine 5 and warms up rapidly.

In order to ensure that the temperature of the oil picked up from the catchment volume 29 is maintained as high as possible when it passes through the engine 5 at least one of the oil transfer passages 12, 14 according to this invention includes a means to reduce the transfer of heat from the oil to the engine 5. In respect of this invention, a material having a low thermal conductivity is one where the thermal conductivity is such that the heat transferred from the oil to the engine is considerably less than if there were to be direct contact between the oil and the surrounding part of the engine. The means to reduce the transfer of heat is a thermal barrier that is to say it is resistant to heat transfer and is formed by a material having a low thermal conductivity such as plastic or by the interposing of a material having a low thermal conductivity such as air or engine oil or by separating a tube through which the oil flows by other means that reduce the flow of heat such as for example thin elongate ribs or fins.

In general terms a material having low thermal conductivity is one where the thermal conductivity is such that the heat transferred is considerably less than the heat transferred by direct contact between the oil and the engine. So for example, a plastic material having a thermal conductivity in the range of 0.1 to 0.5 W/m K is a low conductivity material but aluminum that has a thermal conductivity in the order of 200 W/m K would not be considered to have a low thermal conductivity. In some examples, the low thermal conductivity may be lower than any of the thermal conductivity of any of the metals comprising the engine, such as the engine cylinder block, engine cylinder head, camshafts, crankshaft, connecting rods, valves, springs, journals, and/or other metal engine components.

Referring now to FIGS. 2 and 3 shows a means to reduce the transfer of heat from the oil to the surrounding part 6 of the engine 5 is shown as applied to the second oil gallery 14.

The oil transfer passage 14 is formed as an integral part of the cylinder block 6 by any suitable means but, as is well known in the art, is normally formed by a mechanical machining process such as boring or drilling to produce a fine surface finish and then sealed off at each end by the use of end plugs 20. In one embodiment, the second oil gallery in the form of the oil transfer passage 14 has a thick walled plastic tube 30 fitted therein. The plastic tube 30 is push fitted into the oil transfer passage 14 such that an outer surface 34 of the plastic tube 30 engages with a cylindrical wall 33 defining the oil transfer passage 14. In another embodiment, due to the presence of the closed cell foam tube 30, the oil is no longer in direct contact with the cylindrical wall 33 and so it is possible with certain engine constructions to leave the cylindrical wall 33 in an un-machined state.

The plastic tube or closed cell foam tube 30 comprises a tubular portion 35 (e.g. a bore) defining an oil flow passage 31 through which oil flows in use to one or more crankshaft bearings (not shown) of the engine 5 via separate subsidiary oil transfer passages 14B of which only one is shown in FIG.

2. The plastic tube 30 is a longitudinal oil passing within oil flow passage 31 parallel to the crankshaft. Further, subsidiary oil transfer passages 14B are positioned vertically, pass through plastic tube or closed cell foam tube 30, and do not contain a thermal barrier such as a plastic tube. In this way, the subsidiary oil transfer passages 14B are openings or outlets directly in the engine cylinder block 6 (e.g., in the material 80 forming the cylinder block), whereas outer walls of the plastic tube 30 are adjacent to, and press fit into, passages in the metal cylinder block material 80 of the cylinder block 6. Subsidiary oil transfer passages 14B contain a plurality of downward-opening apertures formed in cylinder block 6, the apertures opening only vertically downward. Each of the subsidiary oil transfer passages 14B is formed in the cylinder block 6 by a mechanical machining process such as boring or drilling after the plastic tube or closed cell foam tube 30 has been pushed into place so that corresponding apertures 32 are formed in the plastic tube or closed cell foam tube 30 connecting the oil flow passage 31 with the various subsidiary oil transfer passages 14B.

Because plastic and the closed cell foam, from which the closed cell foam tube is made, are relatively poor conductors of heat, that is to say, it is a thermal insulator, the rate of heat transfer from the oil to the cylinder block 6 is considerably reduced compared to the case where there is direct contact between the oil and the wall 33 of the oil transfer passage 14. As a consequence of this reduced heat transfer, the temperature of the oil reaching the main bearings will be maintained higher than would be the case for direct contact between oil and cylinder block 6 thereby reducing friction and improving fuel economy. This is particularly the case following a cold engine start-up because the engine 5 is then likely to be at ambient temperature and will take a considerable period of time to warm up.

The plastic or closed cell foam tube 30 provides an insulating layer between the oil flowing through it and the cylinder block 6 thereby reducing the transfer of heat from the oil to the cylinder block 6. The plastic or closed cell foam tube 30 therefore forms a thermal barrier between the oil and the engine by providing a thick layer of material having a low thermal conductivity namely plastic or closed cell foam.

It will be appreciated that a similar means to reduce the transfer of heat from the oil to the engine could also be incorporated into each of the subsidiary oil transfer passages if required. Furthermore it could also be used in the first oil gallery 12.

It will be appreciated that the plastic tube 30 could be made by extruding a material such as polypropylene or Nylon 66.

It will be appreciated that an engine such as the engine 5 using a closed cell foam tube 30 could be manufactured in various ways some of which are described hereinafter. In a first method for manufacturing the engine 5, the cylinder block 6 is cast in the normal manner and the oil transfer passage 14 is produced in the cylinder block 6 either as part of the casting process or by a subsequent machining process.

The closed cell foam tube 30 is preformed ready for insertion into the oil transfer passage 14.

One method for manufacturing an elastomeric closed cell foam tube uses a synthetic rubber blend such as nitrile butadiene rubber (NBR) and/or ethylene-propylene-diene monomer (EPDM); Polyvinyl chloride (PVC) and a chemical foaming agent. These three components are combined and the mixture is then put through extruding equipment to form the required object, typically either a round tube or a flat sheet. The extruded object is then heated in an oven to a specific temperature which causes the chemical foaming agent to change from a solid to a gas. When this occurs, thousands of small air pockets normally referred to as cells are produced. The object is then cooled in a predefined manner to ensure that the closed cells remain unbroken and intact. The extruded object is then cut to size ready for use.

An alternative method for manufacturing a closed cell foam tube is disclosed by way of example and without limitation in US Patent Publication 2002/0036363. In this process inorganic gas is used to create the cells rather than a foaming agent.

The closed cell foam tube 30 can therefore either be manufactured directly by extruding a tube shape as discussed above or by producing a flat sheet and then rolling the flat sheet over a former and adhesively bonding the edges of the flat sheet to form the closed cell foam tube 30.

Figure 4:
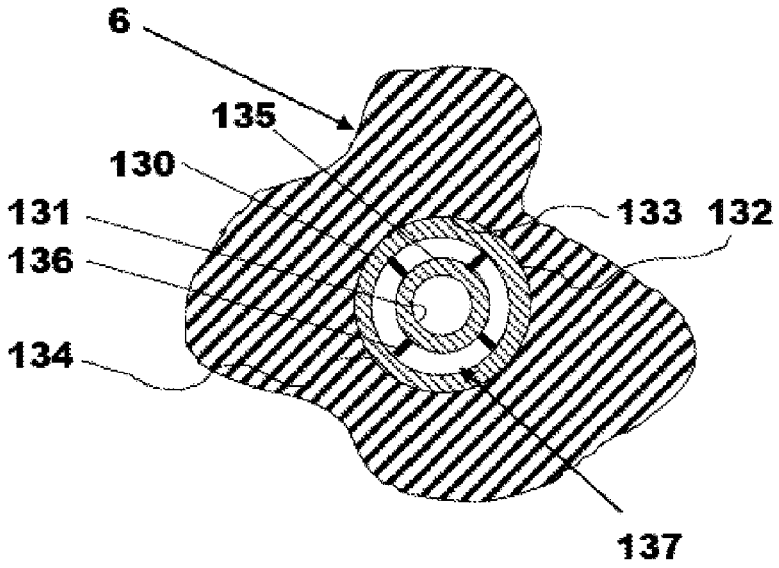
FIG. 4 shows a cross-section of a thermal barrier including an inner and outer tubular component.
Figure 5:
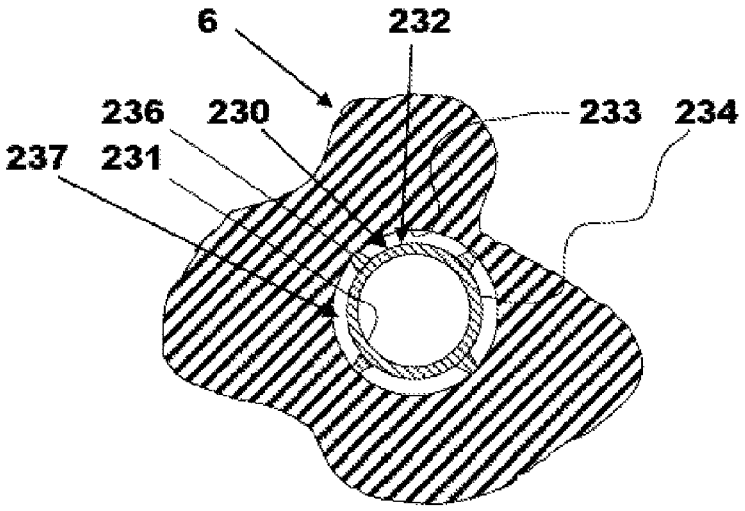
FIG. 5 shows a cross-section of a thermal barrier including a tubular component with longitudinally extended ribs or fins.

With reference to FIG. 4 there is shown a second embodiment of a means to reduce the transfer of heat from the oil to the engine that is intended to be a direct replacement for the single plastic tube shown in FIGS. 2 and 3.

As before, the second oil gallery in the form of the oil transfer passage 14 has a plastic tubular component 130 fitted therein. The plastic tubular component 130 is push fitted into the oil transfer passage 14 such that an outer surface 134 of an outer plastic tube 132 engages with a cylindrical wall 133 defining the oil transfer passage 14. As before, the oil transfer passage 14 is formed as an integral part of the cylinder block 6 by any means.

The plastic tubular component 130 comprises an inner plastic tube 135 defining an oil flow passage 131 through which oil flows in use to one or more main bearings (not shown) of the engine via the separate subsidiary oil transfer passages 14B (not shown in FIG. 4) and the outer plastic tube 132 connected to the inner plastic tube 135 by a number of ribs or fins 136 so as to space the inner and outer plastic tubes 135, 132 apart. A number of compartments 137 are formed between the inner and outer tubular portions 135, 132 which may contain air or oil but in either case provide an additional thermal barrier between the oil flowing through the oil flow passage 131 and the cylinder block 6. The combination of the use of a material that acts as a thermal insulator and the thermal barrier provided by the compartments 137 provides a significant reduction in the transfer of heat from the oil to the cylinder block 6 compared to the case where there is direct contact between the oil and the wall 133 of the oil transfer passage 14. As a consequence of this reduced heat transfer, the temperature of the oil reaching the main bearings will be maintained higher thereby reducing friction and improving fuel economy.

As before, each of the subsidiary oil transfer passages 14B is formed in the cylinder block by a mechanical machining process such as boring or drilling after the plastic tubular component 130 has been pushed into place so that apertures (not shown) are formed in the inner and outer plastic tubes 135 and 132 connecting the oil flow passage 131 with the various subsidiary oil transfer passages 14B.

The plastic tubular component 130 forms a thermal barrier between the oil and the engine by providing two layers of material having a low thermal conductivity namely plastic and other material providing a thermal barrier in the form of the air or oil trapped in the compartments 137.

It will be appreciated that the plastic tubular component 130 could be made by extruding a material such as polypropylene or Nylon 66.

With reference to FIG. 5 there is shown a third embodiment of a means to reduce the transfer of heat from the oil to the engine that is intended to be a direct replacement for the plastic tube shown in FIGS. 2 and 3.

As before, the second oil gallery in the form of the oil transfer passage 14 has a tube 230 made from plastic fitted therein. The plastic tube 230 is push fitted into the oil transfer passage 14 such that a number of ribs or fins 236 formed on an outer surface 234 of a tubular portion 232 of the plastic tube 230 engage with a cylindrical wall 233 defining the oil transfer passage 14. As before, the oil transfer passage 14 is formed as an integral part of the cylinder block 6 by any means.

The tubular portion 232 defines an oil flow passage 231 through which oil flows in use to one or more main bearings (not shown) of the engine via the separate subsidiary oil transfer passages 14B (not shown in FIG. 5).

The ribs or fins 236 extend longitudinally along the plastic tube 230 and space the tubular portion 232 from the wall 233 of the cylinder block 6 thereby defining a number of compartments 237 which may contain air or oil but in either case provide a thermal barrier between the oil flowing through the oil flow passage 231 and the cylinder block 6.

The combination of the use of a plastic material for the tubular portion 232 and the ribs 236 that act as a thermal insulator and the thermal barrier provided by the compartments 237 provides a significant reduction in the transfer of heat from the oil to the cylinder block 6 compared to the case where there is direct contact between the oil and the wall 233 of the oil transfer passage 14. As a consequence of this reduced heat transfer, the temperature of the oil reaching the main bearings will be maintained higher thereby reducing friction and improving fuel economy.

As before, each of the subsidiary oil transfer passages 14B is formed in the cylinder block by a mechanical machining process such as boring or drilling after the plastic tube 230 has been pushed into place so that apertures (not shown) are formed in the tubular portion 232 of the plastic tube 230 connecting the oil flow passage 231 with the various subsidiary oil transfer passages 14B.

It will be appreciated that the plastic tube 30 could be made by extruding a material such as polypropylene or Nylon 66.

Figure 6A:
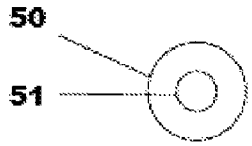
FIG. 6A shows an end view of a thermal barrier including a tubular component.
Figure 6B:
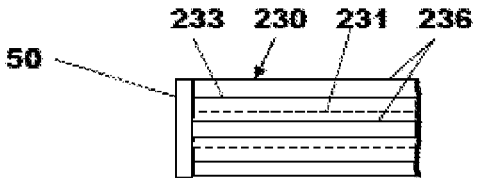
FIG. 6B shows a side view of the end cap as fitted to the tubular component.

With reference to FIGS. 6A and 6B there is shown a first embodiment of an end cap 50 for the plastic tube 230 shown in FIG. 5. The end cap 50 is in the form of an annular disc that has a central aperture 51 that allows the oil, that is exiting the plastic tube, to flow into the oil flow passage 231 of the plastic tube 230 from the delivery passage 15 but prevents the flow of oil into the compartments 237 from the delivery passage 15. This ensures that most of the compartments 237 contain only air and limits or in some cases prevents the flow of oil from the delivery passage 15 to the subsidiary oil transfer passages 14B.

Figure 7A:
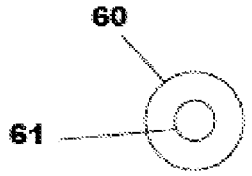
FIG. 7A shows an end view of an inner and outer tubular component.
Figure 7B:
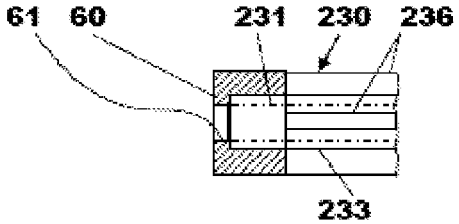
FIG. 7B shows a side view of the end cap as fitted to the tubular component.

With reference to FIGS. 7A and 7B there is shown a second embodiment of an end cap 60 for the plastic tube 230 shown in FIG. 5. The end cap 60 is a cup shaped and has a central aperture 61 that allows oil to flow into the oil flow passage 231 of the plastic tube 230 from the delivery passage 15 but prevents the flow of oil into the compartments 237 from the delivery passage 15. This ensures that most of the compartments 237 contain only air and limits or in some cases prevents the flow of oil from the delivery passage 15 to the subsidiary oil transfer passages 14B.

It will be appreciated that the end caps 50 and 60 could be applied to the plastic tube 130 shown in FIG. 4 with similar beneficial effects.

Figure 8A:
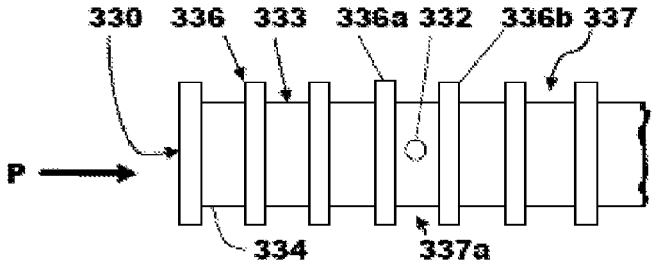
FIG. 8A shows a side view of a tubular component with longitudinally extended ribs or fins.
Figure 8B:
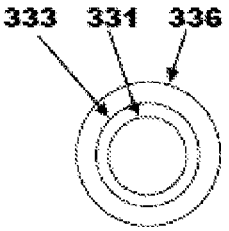
FIG. 8B shows an end view of a tubular component with longitudinally extended ribs or fins.

With reference to FIGS. 8A and 8B there is shown a fourth embodiment of a means to reduce the transfer of heat from the oil to the engine that is intended to be a direct replacement for the plastic tube shown in FIGS. 2 and 3.

As before, the second oil gallery in the form of the oil transfer passage 14 (not shown in FIGS. 8A and 8B) has a tube 330 made from plastic fitted therein. The plastic tube 330 is push fitted into the oil transfer passage 14 such that a number of circumferentially extending ribs or fins 336 formed on an outer surface 334 of a tubular portion 333 of the plastic tube 330 engage with a cylindrical wall (not shown in FIGS. 8A and 8B) defining the oil transfer passage 14. As before, the oil transfer passage 14 is formed as an integral part of the cylinder block 6 by any means.

The tubular portion 333 defines an oil flow passage 331 through which oil flows in use to one or more main bearings (not shown) of the engine via the separate subsidiary oil transfer passages 14B (not shown in FIGS. 8A and 8B).

The ribs or fins 336 space the tubular portion 333 from the wall of the cylinder block 6 and define a number of compartments 337 most of which contain air which provides a thermal barrier between the oil flowing through the oil flow passage 331 and the cylinder block 6. At locations corresponding to where the subsidiary oil transfer passages 12B are connected to the oil flow passage 331 via apertures 332 (only one of which is shown) respective compartments 337*a* (only one shown) are defined between two adjacent ribs 336*a* and 336*b* which contain oil and not air due to their connection to the oil flow passage 331 by the aperture 332. However, the oil within the respective compartment 337*a* is substantially stationary and also provides a thermal barrier between the oil flowing through the oil flow passage 331 and the cylinder block 6 and reduces heat transfer compared to direct oil to cylinder block 6 contacts.

It will be appreciated that the compartment between the ribs 336*a* and 336*b* could be omitted so that in this case only plastic would be present at the positions where the oil flow passage 331 connects to the oil transfer passages 12B. This has the advantage that it is more difficult for oil to leak into the other compartments 337 thereby reducing the transfer of heat across the compartments 337 because air has a lower thermal conductivity than oil.

The combination of the use of a plastic material that acts as a thermal insulator and the additional thermal barrier provided by the compartments 337 provides a significant reduction in the transfer of heat from the oil to the cylinder block 6 compared to the case where there is direct contact between the oil and the wall of the oil transfer passage 14. As a consequence of this reduced heat transfer, the temperature of the oil reaching the main bearings will be maintained higher thereby reducing friction and improving fuel economy.

As before, each of the subsidiary oil transfer passages 14B is formed in the cylinder block by a mechanical machining process such as boring or drilling after the plastic tube 330 has been pushed into place so that the apertures 332 are formed in the tubular portion 333 of the plastic tube 330 connecting the oil flow passage 331 with the various subsidiary oil transfer passages 14B.

It will be appreciated that the plastic tube 330 could be made by injection molding a material such as polypropylene or Nylon 66.

Insertion of the closed cell foam tube 30 into the oil transfer passage 14 is performed with the aid of an insertion device. A first embodiment of an insertion device 37 is shown in FIGS. 11A, 11B, 11C, 12A and 12B.

Figure 12A:
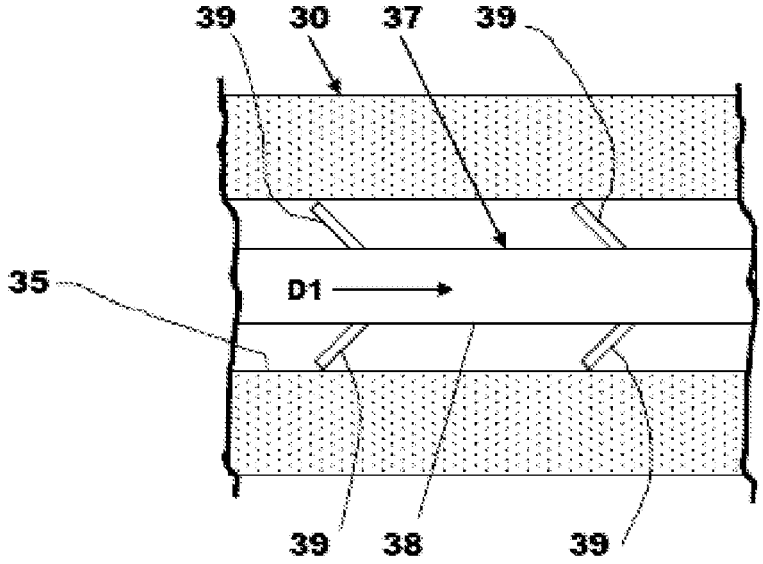
FIG. 12A shows a schematic diagram of an insertion device for closed cell foam tube in a non-engaged operating state.
Figure 12B:
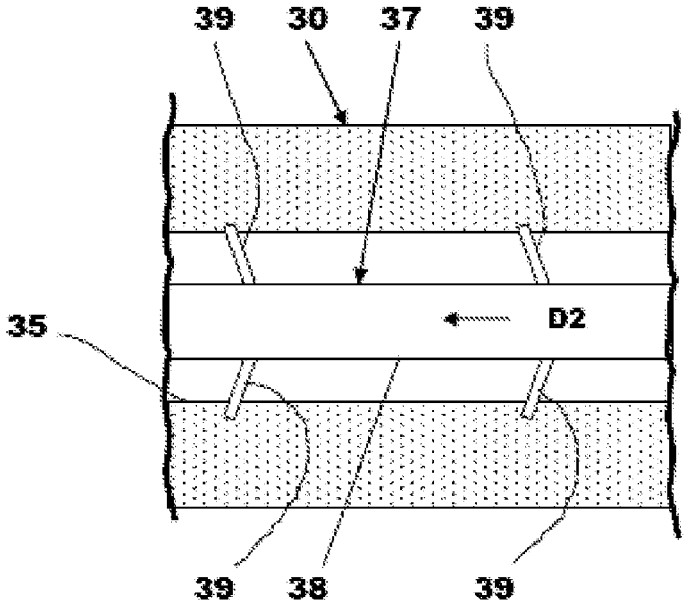
FIG. 12B shows a schematic diagram of an insertion device for a closed cell foam tube in an engaged operating state.

Referring firstly to FIGS. 12A and 12B the insertion device 37 comprises of an elongate rod or tube 38 from which extends a number of barbs 39. The barbs 39 are orientated at an angle with respect to an outer surface of the elongate rod or tube 38 such that, when the insertion device 37 is inserted into the bore 35 of the closed cell foam tube 30 and moved in the direction 'D1' relative to the closed cell foam tube 30 as shown in FIG. 12A, the barbs 39 are deflected so as to permit the insertion device 37 to be inserted into the bore 35 of the closed cell foam tube 30. When in a free state the diametric distance between tips of each pair of opposite barbs 39 is slightly greater than the diameter of the bore 35. Therefore, when the insertion device 37 is engaged with the bore 35, the barbs 39 are deflected so as to produce a small force biasing the barbs 39 into contact with the bore 35. However, when the insertion device 37 is moved in the direction 'D2' relative to the closed cell foam tube 30 as shown in FIG. 12B, the barbs 39 engage with or dig into the bore 35 of the closed cell foam tube 30 so as to produce a drivable connection there between.

Figure 11A:
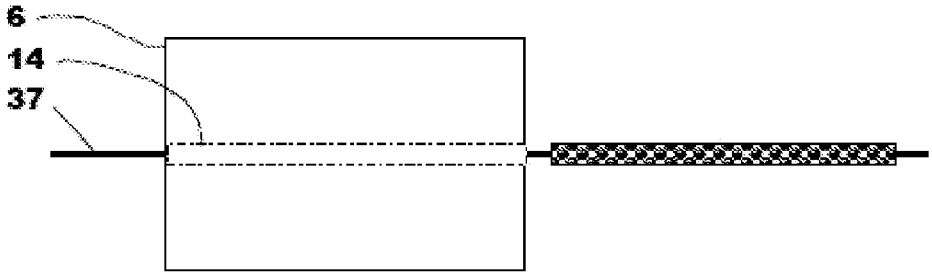
FIG. 11A shows a schematic diagram of an insertion device including a closed cell foam tube.

Referring now to FIG. 11A, the insertion device 37 is shown extending through the oil transfer passage 14 and through the closed cell foam tube 30 ready for insertion of the closed cell foam tube 30 into the oil transfer passage 14.

Figure 11B:
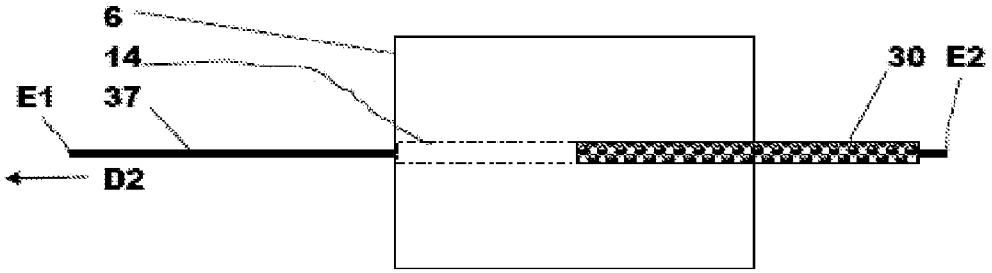
FIG. 11B shows a schematic diagram of a partial insertion of a closed cell foam tube.

In FIG. 11B the closed cell foam tube 30 is shown partly inserted into the oil transfer passage 14. To achieve this the insertion device 37 is either pulled at end 'E1' or pushed from end 'E2' causing it to move in the direction 'D2' thereby causing the barbs 39 to be engaged with the bore 35 of closed cell foam tube 30 as soon as the closed cell foam tube 30 begins to engage with the oil transfer passage 14. Continued movement of the insertion device 37 in the direction 'D2' causes the closed cell foam tube 30 to be pulled into the oil transfer passage 14.

The closed cell foam tube 30 has an outer diameter slightly greater than the diameter of the oil transfer passage 14 and so a light interference fit or push fit is produced there between when the closed cell tube 30 engages with the oil transfer passage 14.

Figure 11C:
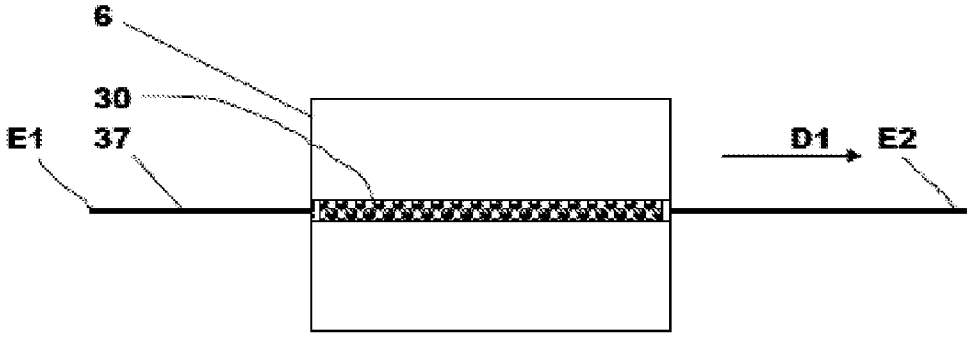
FIG. 11C shows a schematic diagram of a removal of the insertion device.

When the closed cell foam tube 30 is positioned correctly within the oil transfer passage 14 (as shown in FIG. 11C, the direction of movement of the insertion device 37 is reversed so that it moves in the direction 'D1' shown on FIG. 11C. To achieve this motion the insertion device 37 is either pulled at end 'E2' or pushed from end 'E1' causing it to move in the direction 'D1'. This motion will cause the barbs 39 to disengage with the bore 35 of closed cell foam tube 30 thereby leaving the closed cell foam tube 30 correctly located within the oil transfer passage 14. It will be appreciated that the closed cell foam tube 30 is held in position within the oil transfer passage 14 by the interference or push fit there between and/or by adhesive if previously applied to at least one of the outer surface 34 of the closed cell foam tube 30 or to the oil transfer passage 14.

After the closed cell foam tube 30 is in position, each of the subsidiary oil transfer passages 14B is formed in the cylinder block 6 and the apertures 32 are formed in the closed cell foam tube 30 at the same time. An end cap 20 is then fitted to each end of the oil transfer passage 14 so as to seal it off.

FIG. 13 shows a second embodiment of an insertion device that is intended to be a direct replacement for the insertion device 37 and which is used in an identical manner to pull the closed cell foam tube 30 into the oil transfer passage 14.

The insertion device 40 comprises a tubular member 41 having a number of elongate apertures 47 formed therein and an actuating member 42 located with a bore of the tubular member 41. The actuating member 42 includes a head 43 used to pivotally support in this case two barbs 44. Each of the barbs is pivotally connected to the head 43 via a respective pivot pin 45.

It will be appreciated that there could be several heads 43 and associated barbs 44 spaced out along the actuating member 42.

Each of the barbs 44 has a wedging surface 46 positioned adjacent an inclined end wall 48 of each elongate aperture 47.

When the actuating member 42 is moved in the direction 'D' relative to the tubular member 41, the wedging surfaces 46 of the barbs 44 engage with the inclined end walls 48 of the elongate apertures 47 causing the barbs 42 to be rotated in an outward direction from the retracted position shown in FIG. 8.

To use the insertion device 40 it is first pushed into the bore 35 of the closed cell tube 30 with the barbs 44 fully retracted as shown in FIG. 13. The actuating member 42 is then pulled in the direct of arrow 'D' causing the barbs 44 to engage with the bore 35 of the closed cell foam tube 30 so as to produce a driving connection there between.

The insertion device 40 along with the attached closed cell foam tube 30 is then pulled through the oil transfer passage 14 using the actuating member 42 until the closed cell foam tube 30 is correctly positioned. The actuating member 42 is then moved in an opposite direction allowing the barbs 44 to disengage from the bore 35 of the closed cell foam tube 30 and the insertion device 40 is pushed out of the bore 35 of the closed cell foam tube 30 by the motion of the actuating member 42.

After the closed cell foam tube 30 is in position, each of the subsidiary oil transfer passages 14B is formed in the cylinder block 6 so that the apertures 32 are formed in the closed cell foam tube 30. An end cap 20 is then fitted to each end of the oil transfer passage 14 so as to seal it off.

As an alternative to the above referred to method the closed cell foam material is injected into the oil transfer passage 14 so as to totally fill it. After the foam material has set or cooled, the bore 35 is produced so as to create the oil flow passage 31. The apertures 32 in the closed cell foam tube 30 connecting the oil flow passage 31 to the subsidiary oil transfer passages 14B are then produced preferably at the same time as the subsidiary oil transfer passages 14B are formed in the engine block 6.

The bore 35 can be produced by any convenient method such as, for example and without limitation, machining, laser cutting and melting using a hot tool.

FIG. 14 shows in a diagrammatic manner an end portion of a foam injection device 70 that could be used to inject closed cell foam into the oil transfer passage 14. The foam injection device 70 comprises an elongate tubular stem 71 supporting an injection head 72 in which are formed a number apertures 73. In use a foamable material is pumped at pressure through the elongate tubular member 73 to the injection head 72 and sprays out via the apertures 73. To form the closed cell foam tube 30 in the oil transfer passage 14 the foam injection device 70 is inserted into the oil transfer passage 14 such that it extends substantially the whole length of the oil transfer passage 14. The material used to produce the foam is then pumped to the apertures 73 and at the same time the foam injection device 70 is moved in the direction of the arrow 'M' so as to retract it slowly from the oil transfer passage 14. As it traverses through the oil transfer passage 14 a layer of foamable material is applied to the cylindrical wall 33 of the oil transfer passage 14. In some cases the foam injection device 70 may be simultaneously be retracted and rotated as indicated by the arrows 'M' and 'R' respectively.

When the entire cylindrical wall 33 has been coated with foamable material, the flow of foamable material to the apertures is stopped and the foam injection device 70 is either cleaned or transferred to another engine requiring treatment. The cylinder block 6 is then heated to cause bubbles to form in the foamable material or the cells are formed by a chemical reaction in either case a closed cell foam layer is produced within the oil transfer passage 14.

A bore is then formed in the closed cell foam material to produce the closed cell foam tube 30.

Figure 9:
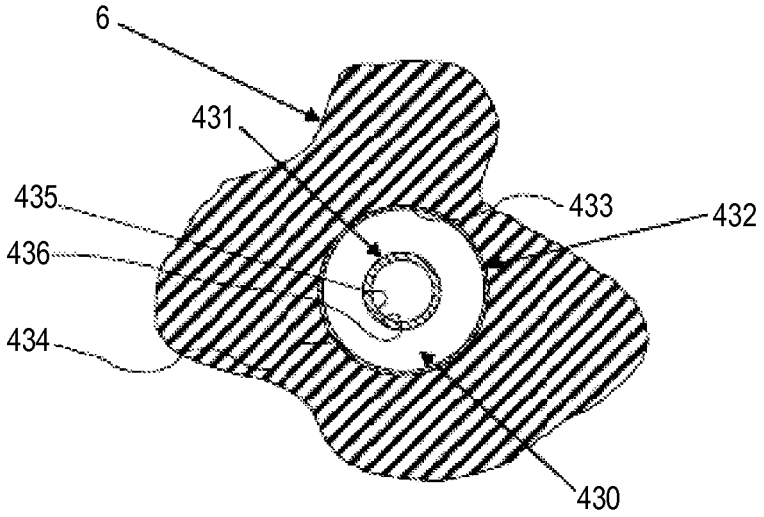
FIG. 9 shows a cross-section of a composite tube assembly including a closed cell foam tube and an inner and outer tube.
Figure 10:
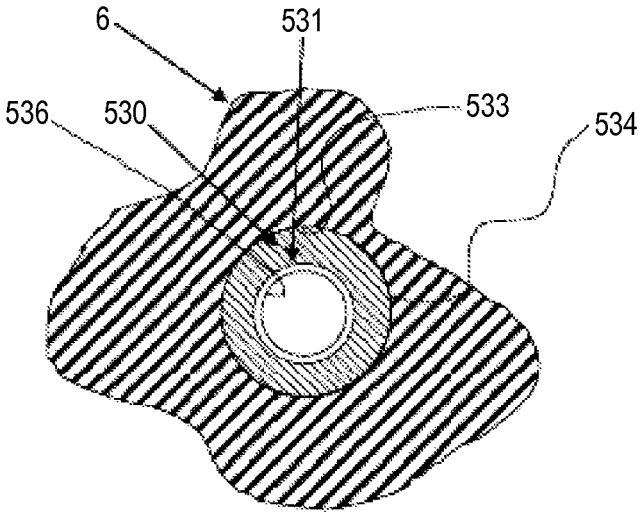
FIG. 10 shows a cross-section of a composite tube assembly including an outer closed cell foam tube and an inner tube.

Referring now to FIG. 9 there is shown a second embodiment of a means to reduce the transfer of heat from the oil to the surrounding part 6 of the engine 5 in the form of a composite tube assembly including a closed cell foam tube 430 coupled to an inner tube 431 and an outer tube 432.

The composite tube assembly 430, 431, 432 is intended to be a direct replacement for the closed cell foam tube 30 shown in FIGS. 2 and 3.

As before, the second oil gallery in the form of the oil transfer passage 14 has a closed cell foam tube 437 fitted therein and the oil transfer passage 14 is formed as an integral part of the cylinder block 6 by any means.

The closed cell foam tube 430 is formed between the inner tube 431 and the outer tube 432. The closed cell foam tube 430 therefore spaces the inner and outer tubular portions 431, 432 apart.

The inner tube 431 has bore 435 defining an oil flow passage through which oil flows in use to one or more main bearings (not shown) of the engine 5 via the separate subsidiary oil transfer passages 14B (not shown in FIG. 9)

An outer surface 434 of the outer tube 432 engages with a cylindrical wall 433 defining the oil transfer passage 14 so as to hold the composite tube assembly 430, 431, 432 in position within the oil transfer passage 14.

Preferably, the inner and outer tubes 431 and 432 are thin plastic tubes 431, 432 and may typically made by an extrusion process. Extruded lengths of tube are cut to length to suit the particular oil transfer passage 14 into which they are intended to fit. It will be appreciated that materials other than plastic could be used but plastic is preferred because it is a thermal insulating material having a low thermal conductivity. Typical plastics for the inner and outer tubes 431 and 432 are polypropylene and Nylon 66 but any suitable oil and temperature resistant plastic could be used. The inner and outer tubes 431 and 432 reinforce the closed cell foam tube 430 and enable easier assembly.

The closed cell foam tube 430 forms a significant thermal barrier between the oil and the engine 5 by having a low thermal conductivity. By using such a composite tube 430, 431, 432, heat transfer from the oil to the surrounding part 6 of the engine 5 is significantly reduced. This is particularly the case if the inner and outer tubes 431 and 432 are made from a material having a low thermal conductivity such as plastic. The temperature of the oil reaching the main bearings will therefore be maintained higher thereby reducing friction and improving fuel economy. Less heat is therefore lost from the oil to the engine 5 particularly during the period following an engine start-up from cold which is a critical period of time so far as friction and wear is concerned.

If the material used for the inner and outer tubes 431 and 432 has a low thermal conductivity then this will provide an additional thermal barrier between the oil and the surrounding part 6 of the engine 5.

The composite tube assembly 430, 431, 432 can be manufactured in several ways. Firstly, by producing all three components 430, 431, 432 and then assembling them by pushing or pulling the inner tube 431 into a bore 436 of the closed cell foam tube 430 and then pushing or pulling the outer tube 432 over the closed cell foam tube 430.

Secondly, by producing all three components 430, 431, 432 and then assembling them by pushing or pulling the closed cell foam tube 430 into the outer tube 432 and then pushing or pulling the closed cell foam tube 430 over the inner tube 431 to engage it with the bore 436 of the closed cell foam tube 430.

Thirdly, by injecting foam between the inner and outer tubes 431 and 432 while holding the inner and outer tubes 431 and 432 in a concentrically aligned state. After the foam has set or cooled the composite tube assembly 430, 431, 432 is formed. Whatever method is used for manufacturing the composite tube assembly 430, 431, 432, the composite tube assembly 430, 432, 434 is then pushed or pulled into the oil transfer passage 14 into a predefined position.

Each of the subsidiary oil transfer passages 14B is formed in the cylinder block 6 by a mechanical machining process such as boring or drilling.

If the subsidiary oil transfer passages 14B are formed in the cylinder block 6 before the composite tube assembly 430, 431, 432 has been inserted into the oil transfer passage 14, then apertures (not shown) have to be separately formed in the composite tube assembly 430, 431, 432 in predefined locations before it is inserted to match up with the subsidiary oil transfer passages 14B.

If the subsidiary oil transfer passages 14B are formed in the cylinder block 6 after the composite tube assembly 430, 431, 432 has been inserted into the oil transfer passage 14, the apertures are formed at the same time as the subsidiary oil transfer passages 14B.

In either case, the apertures formed in the inner and outer tube 431 and 432 and the closed cell foam tube 430 connect the oil flow passage 435 with the subsidiary oil transfer passages 14B.

After correctly positioning the composite tube assembly 430, 431, 432 within the oil transfer passage 14, an end cap 20 is fitted to each end of the oil transfer passage 14 so as to seal it off.

Referring now to FIG. 10 there is shown a third embodiment of a means to reduce the transfer of heat from the oil to the surrounding part 6 of the engine 5 in the form of a composite tube assembly including a closed cell foam tube 530 and an inner tube 531.

The composite tube assembly 530, 531 is intended to be a direct replacement for the closed cell foam tube 30 shown in FIGS. 2 and 3. As before, the second oil gallery in the form of the oil transfer passage 14 is formed as an integral part of the cylinder block 6 by any means.

The inner tube 531 is used in combination with an outer closed cell foam tube 530 to form the composite tube assembly 530, 531. The composite tube assembly 530, 531 is positioned in the oil transfer passage 14 such that an outer surface 534 of the foam tube 530 engages with a cylindrical wall 533 of the cylinder block 6 defining the oil transfer passage 14.

The closed cell foam tube 530 provides a good thermal barrier between the oil flowing through an oil flow passage defined by a bore 536 of the inner tube 531 and the cylinder block 6.

Preferably, the inner tube 531 is a thin plastic tube and is made from, for example, polypropylene or Nylon 66. However any suitable oil and temperature resistant plastic could be used. One advantage of using a thin plastic tube is that plastic has a low thermal conductivity.

Oil flows through the oil flow passage in use to one or more main bearings (not shown) of the engine 5 via the subsidiary oil transfer passages 14B and apertures in the composite tube assembly 530, 531 (not shown in FIG. 5) that are aligned with the subsidiary oil transfer passages 14B.

The combination of a plastic inner tube 531 and a closed cell foam tube 530 provides an excellent thermal insulator and thermal barrier between the oil and the surrounding part 6 of the engine 5. Such a combination therefore provides a significant reduction in the transfer of heat from the oil to the cylinder block 6 compared to a case where there is direct contact between the oil and the cylindrical wall 533 of the oil transfer passage 14. As a consequence of this reduced heat transfer, the temperature of the oil reaching the main bearings will be maintained higher thereby reducing friction and improving fuel economy. This is particularly the case following an engine start-up from cold, where friction and wear are problems while the oil remains cold, due to the reduced loss of heat from the oil to the engine 5.

The composite tube assembly 530, 531 can be manufactured in several ways two examples of which follow hereinafter. Firstly, by producing the two components 530, 531 and then assembling them together. The composite tube assembly 530, 531 can then be pushed or pulled into the oil transfer passage 14 into a predefined position.

Secondly, by in-situ injection of foam in between the inner tube 531 and the cylindrical wall 533 of the oil transfer passage 14. During this process the inner tube 531 is held in a concentrically aligned position within the oil transfer passage 14 while a foamable material is injected to form the closed cell foam tube 530.

Each of the subsidiary oil transfer passages 14B is formed in the cylinder block 6 by a mechanical machining process such as boring or drilling.

If the subsidiary oil transfer passages 14B are formed in the cylinder block 6 before the composite tube assembly 530, 531 is in position, then apertures (not shown) may be separately formed in the composite tube assembly 530, 531 in predefined locations prior to insertion of the composite tube assembly 530, 531 into the oil transfer passage 14 to match up with the subsidiary oil transfer passages 14B.

If the subsidiary oil transfer passages 14B are formed in the cylinder block 6 after the composite tube assembly 530, 531 is in position, then the apertures are formed at the same time as the subsidiary oil transfer passages 14B.

The respective apertures formed in the inner tube 531 and the closed cell foam tube 530 are used to connect the oil flow passage 532 with the subsidiary oil transfer passages 14B.

After correctly positioning the composite tube assembly 530, 531 in the oil transfer passage 14, an end cap 20 is fitted to each end of the oil transfer passage 14 so as to seal it off.

Although the invention has been described by way of several examples as applied to the oil transfer passage 14 in the cylinder block 6, it will be appreciated that it could also be applied with advantage to the oil transfer passage 12 formed in the cylinder head, to both of these oil transfer passages 12 and 14 or to other oil transfer passages formed as part of the engine such as for example the delivery passage 15 or the two drainage passages 22, 24.

Although the invention as thus far been described with respect to use with an oil transfer passage in which the supply of oil is from one end of the transfer passage this is not always the case. Oil delivery passages 15 in some engines join the passages 12 & 14 part way down their length rather than the end. With such an arrangement oil will want to flow into the compartments 137 and 237 shown in FIGS. 4 and 5 if a feed passage to a main bearing for example also connects into the same region, thereby reducing the benefit of the invention. To avoid this problem the ribs 136 and 236 could extend in a helical manner along the length of the respective tubes 130, 230 so as to avoid direct alignment between feed and exits from oil passages 12 & 14.

Alternatively, the ribs 136, 236 could extend helically in both clockwise and anti-clockwise directions so as to form enclosed zones.

It will however be appreciated that such a problem will not arise if the solid plastic tube 30 shown in FIGS. 2 and 3 is used for such central feed arrangements.

It will also be appreciated by those skilled in the art that the invention is not limited to use with an inline engine as shown in FIG. 1 but could also be applied to other engine configurations having integrally formed oil transfer passages such as for example a flat configuration or a V configuration.

It will be appreciated that the oil circulation pump could be mounted on the engine as shown or could be a separate unit attached to the engine and could be driven in either case by the engine or by other means such as for example an electric motor.

In accordance with a second aspect of the invention a method of reducing fuel usage of an engine having a number of oil transfer passages 12, 14 formed therein is provided.

The method comprises push fitting a plastic tube defining an oil flow passage through which the oil flows in use into the respective oil transfer passage.

In some embodiments the plastic tube has a number of ribs formed on an outer surface to space the plastic tube from a wall of the oil transfer passages.

In other embodiments the plastic tube is an inner tube defining an oil flow passage through which the oil flows in use and a number of ribs formed on an outer surface of the inner plastic tube are used to space the inner plastic tube from an outer plastic tube that has an outer surface engaging a wall of the oil transfer passages.

It will further be appreciated by those skilled in the art that although the invention has been described by way of example with reference to several embodiments it is not limited to the disclosed embodiments and that alternative embodiments could be constructed without departing from the scope of the invention as defined by the appended claims.

The method comprises generally of producing one or more oil transfer passage 12, 14 in respective parts 7, 6 of the engine 5 and providing at least one oil transfer passage 12, 14 with a thermal barrier to reduce the transfer of heat from oil passing through the oil transfer passage 12, 14 to the surrounding part 7, 6 of the engine 5. In all cases the thermal barrier includes a closed cell foam tube.

As previously discussed, various embodiments of thermal barrier can be used to advantageous effect including a closed cell foam tube located in the oil transfer passage 14, a composite tube assembly comprised of inner and outer plastic tubes 431, 432 spaced apart by a closed cell foam tube 430 located in the oil flow passage 14 and a composite tube assembly comprised of an inner plastic tube 531 and an encircling closed cell foam tube 530 located in the oil flow passage 14.

In some embodiments the closed cell foam tube forming the thermal barrier is produced in-situ and in other cases it is pre-formed and then inserted into the oil transfer passage 14.

In other embodiments the closed cell foam tube is preformed and then assembled with other components to form a composite tube assembly for insertion into the oil transfer passage 14.

In yet further embodiments the closed cell foam tube is formed in-situ as part of a composite tube assembly and the composite tube assembly is then inserted into the oil transfer passage 14.

The term "closed cell foam tube" as meant herein means a closed cell foam tube having a very low thermal conductivity. Such a 'closed cell foam tube' may be manufactured from a polymeric or elastomeric material but other materials such as, for example and without limitation, ceramic foam could be used. One possible material for the ceramic foam is an aluminum oxide matrix structure having many internal closed cells. Such a matrix structure obtains its insulating properties from the many tiny air-filled cells within the material.

It will be appreciated that the thermal inertia of a cylinder block is much greater than the thermal inertia of the sump and hence the need to reduce the heat loss to the cylinder block from the oil especially during an engine warm-up period.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine system, comprising:

an oil transfer passage having a thermal barrier interposed between oil and the engine, the thermal barrier comprising:

a plastic tube having a low thermal conductivity positioned in the oil transfer passage, wherein the plastic tube defines an oil flow passage through which oil pressurized by an oil circulation pump flows in use.

2. The system of claim 1, wherein the plastic tube has a number of external ribs formed thereon to space it from a wall defining the oil transfer passage, wherein the low thermal conductivity of the thermal barrier is lower than a thermal conductivity of any metal comprising the engine.

3. The system of claim 2, wherein the external ribs extend longitudinally along the plastic tube.

4. The system of claim 2, wherein the external ribs extend circumferentially around the plastic tube.

5. The system of claim 4, wherein:

the external ribs define a number of compartments forming part of the thermal barrier;

one or more of the number of compartments comprise an aperture through which oil may exit the plastic tube prior to reaching an end of the plastic tube.

6. The system of claim 2, wherein the plastic tube has an inner plastic tube and an outer plastic tube is spaced apart from the inner plastic tube by the external ribs.

7. The system of claim 6, wherein the inner plastic tube defines an oil flow passage through which the oil pressurized by the oil circulation pump flows, and the outer plastic tube has an outer surface engaging with a wall defining the respective oil transfer passage.

8. The system of claim 1, further comprising a closed cell foam tube coupled to the plastic tube and made from a material having a low thermal conductivity.

9. The system of claim 8, wherein the closed cell foam tube has an outer surface in contact with the oil transfer passage and a bore defining an oil flow passage through which oil flows in use.

10. The system of claim 8, wherein the closed cell foam tube is fitted over the plastic tube defining an oil flow passage through which oil flows in use.

11. The system of claim 8, wherein the closed cell foam tube is fitted over the plastic tube defining an oil flow passage, the system further comprising an outer tube fitted over the closed cell foam tube such that the closed cell foam tube is interposed between the plastic tube and the outer tube.

12. The system of claim 1, wherein:

the engine has a cylinder block and at least one oil transfer passage is a main gallery formed in the cylinder block of the engine;

the oil transfer passage includes a closed cell foam tube coupled between the plastic tube and an inner wall of the oil transfer passage; and the oil transfer passage comprises at least one or more apertures which allow the flow of oil out of the plastic tube and closed cell foam tube and into at least one main bearing of the engine.

13. The system of claim 1, wherein:

the engine has a cylinder head and the at least one oil transfer passage is an oil supply gallery formed in the cylinder head of the engine;

the oil transfer passage includes a closed cell foam tube coupled between the plastic tube and an inner wall of the oil transfer passage; and the oil transfer passage comprises at least one or more apertures which allow the flow of oil out of the plastic tube and closed cell foam tube and into at least one camshaft bearing of the engine.

14. A method for flowing oil, comprising:

pumping oil from a sump to a cylinder block transfer passage to deliver oil to a crankshaft, including flowing oil through a plastic tube positioned in the cylinder block transfer passage.

15. The method of claim 14, further comprising after exiting the plastic tube, flowing oil from out through a bearing supply passage without a plastic tube.

16. The method of claim 14, wherein the plastic tube is positioned longitudinally along the oil transfer passage parallel with the crankshaft.

17. The method of claim 14, wherein the bearing supply passage is positioned vertically, the method including flowing oil vertically downward to the crankshaft.

18. The method of claim 17, wherein the flowing oil is delivered through the oil transfer passage by a circulation pump driven by an engine during an engine cold start operation, wherein the plastic tube comprises an inner plastic tube and an outer plastic tube spaced apart from the inner plastic tube by longitudinally extended external ribs, the oil flowing only through the inner plastic tube, wherein the plastic tube has a plurality of downward-opening apertures, and wherein the apertures of the plastic tube are connected to bearing supply passages.

19. A system, comprising:

a metal engine block having a longitudinally positioned crankshaft therein;

a longitudinal oil passage with a plurality of parallel outlets opening to crankshaft journal bearings, the longitudinal oil passage including an internal plastic tube positioned therein between oil and the metal engine block, the outlets passing through the plastic tube and passing through the metal engine block without any plastic insulator therein.

20. The system of claim 19, wherein an outer wall of the internal plastic tube is flush with an inner wall of the longitudinal oil passage, excepting for the plurality of parallel outlets.

21. The system of claim 19, further comprising:

a closed cell foam tube positioned between the internal plastic tube and the longitudinal oil passage, wherein the outlets pass through the closed cell foam tube without any plastic insulator therein.

22. The system of claim 21, further comprising an outer plastic tube positioned between the closed cell foam tube and the longitudinal oil passage, wherein the outlets pass through the outer plastic tube without any plastic insulator therein.

23. The system of claim 22, wherein the internal plastic tube comprises a plurality of deflectable barbs configured to allow insertion of the internal plastic tube into a bore of the closed cell foam tube in a first direction, and further configured to engage the bore of the closed cell foam tube when the internal plastic tube is moved within the closed cell foam tube in a second direction, opposite the first direction.

* * * * *